US009476262B2

(12) United States Patent
Benson et al.

(10) Patent No.: US 9,476,262 B2
(45) Date of Patent: Oct. 25, 2016

(54) WEAR BUSHING WITH HANGER LOCKDOWN

(71) Applicant: Vetco Gray Inc., Houston, TX (US)

(72) Inventors: Daniel Caleb Benson, Houston, TX (US); David Lawrence Ford, Houston, TX (US); Stephen David Peters, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 236 days.

(21) Appl. No.: 14/218,269

(22) Filed: Mar. 18, 2014

(65) Prior Publication Data

US 2015/0267479 A1 Sep. 24, 2015

(51) Int. Cl.

| | |
|---|---|
| ***E21B 17/00*** | (2006.01) |
| ***E21B 33/03*** | (2006.01) |
| ***E21B 17/10*** | (2006.01) |
| ***E21B 33/068*** | (2006.01) |

(52) U.S. Cl.

CPC ..... *E21B 17/1007* (2013.01); *E21B 33/03* (2013.01); *E21B 33/068* (2013.01)

(58) Field of Classification Search

CPC ..... E21B 33/03; E21B 33/04; E21B 33/02; E21B 33/068; E21B 17/1007; E21B 19/06

USPC ..... 166/75.11

See application file for complete search history.

(56) References Cited

U.S. PATENT DOCUMENTS

| | | | | |
|---|---|---|---|---|
| 5,025,864 | A * | 6/1991 | Nobileau | E21B 33/043 166/208 |
| 5,199,495 | A | 4/1993 | Brammer et al. | |
| 5,762,136 | A | 6/1998 | Oswald | |
| 6,749,018 | B1 * | 6/2004 | Ford | E21B 17/1007 166/208 |
| 2012/0261132 | A1 | 10/2012 | Wilson | |
| 2013/0213661 | A1 | 8/2013 | Reimert | |
| 2015/0114668 | A1 * | 4/2015 | Mansukh | E21B 19/00 166/382 |

OTHER PUBLICATIONS

International Search Report and Written Opinion issued in connection with corresponding PCT Application No. PCT/US2015/018568 dated Sep. 22, 2015.

* cited by examiner

*Primary Examiner* — Michael Wills, III

(74) *Attorney, Agent, or Firm* — Bracewell LLP; Linda L. Morgan

(57) ABSTRACT

A wear bushing assembly protects and locks down a hanger in a wellhead housing; and which includes a wear bushing body that inserts into a wear bushing sleeve. A lock ring extends into registered recesses on the body and sleeve to couple together the body and sleeve. The wellhead housing has a profiled recess circumscribing its inner surface. A lockdown ring selectively mates with the profiled recess; and when mated is in interfering contact with an upper surface of the wear bushing sleeve, thereby coupling the sleeve to the wellhead housing. The sleeve outer surface is profiled to interfere with upward movement of the hanger, so that force is transferred from the hanger to the housing through the sleeve which locks down the housing.

15 Claims, 4 Drawing Sheets

WEAR BUSHING WITH HANGER LOCKDOWN

BACKGROUND OF THE INVENTION

1. Field of Invention

The present disclosure relates in general to a wear bushing for use with a wellhead assembly; and in particular to a wear bushing for use with a wellhead assembly that locks a hanger in the wellhead assembly.

2. Description of Prior Art

Following setting of a casing hanger in a wellhead assembly, a wear bushing is often landed axially above the casing hanger. This is done prior to operations that involve inserting tools and devices (such as a drill bit and drill string) axially through the wellhead assembly to shield the casing hanger(s) and other components in the wellhead housing from damage and wear during these operations. Generally, a casing hanger running tool is mounted onto the drill string and used to land and set the casing hanger. After landing the casing hanger, the casing hanger running tool is removed from the drill string and replaced with a wear bushing running and retrieval tool. The wear bushing running and retrieval tool runs, lands, and sets the wear bushing. After landing the wear bushing, the wear bushing running and retrieval tool may pressure test the wear bushing to ensure that the wear bushing has properly landed on the casing hanger.

Following a successful pressure test, the wear bushing running and retrieval tool is decoupled from the wear bushing and pulled from the wellbore. Various drilling tools may then be attached to the drill string in place of the wear bushing running and retrieval tool. The drilling tools are then run downhole past the wear bushing and the casing hanger to conduct drilling operations. Preferably, the drill tool and drill string will pass through a bore of the casing hanger without contacting or damaging the inner diameter or the rim of the casing hanger. However, if the drill tool is misaligned relative to the casing hanger, the drill tool may contact and damage the casing hanger as it passes through the casing hanger. If a wear bushing is landed axially above the casing hanger, the drill tool will first contact the wear bushing, and, as the drill tool passes through the wear bushing, it will come into alignment with the casing hanger. Thus, the wear bushing protects the casing hanger. In addition, if the drill string rotates eccentrically during the drilling operation, the drill string will contact and wear the wear bushing rather than the casing hanger, thus protecting the casing hanger. After performance of the desired drilling operations, the drill string and the drill tool will be pulled from the wellbore. The wear bushing running and retrieval tool may then be coupled to the drill string in place of the drill tool, and then be run to the wear bushing to pull the wear bushing from the wellbore.

Typically, a lockdown hanger may then be run downhole to land and set above the casing hanger to provide additional casing lockdown capability. The lockdown hanger may be needed due to thermal expansion of the casing string. Lockdown hangers improve long-term seat reliability below the lockdown hanger by sharing the cyclic axial loads applied to the casing hanger. To properly land and set a lockdown hanger, the lockdown hanger is run proximate to lock-ring grooves formed in the subsea wellhead axially above the casing hanger. After landing, a grooved ring of the lockdown hanger will actuate to engage the lock-ring grooves, thereby properly securing the lockdown hanger to the wellhead and casing hanger.

SUMMARY OF THE INVENTION

Disclosed herein are embodiments of a wear bushing assembly for use with a wellhead assembly. In an example, wear bushing is insertable into a wellhead housing and includes an annular wear bushing sleeve having a lower end selectively in interfering contact with an upper end of a hanger that is landed in the wellhead housing. Also included is an annular wear bushing body that inserts within and selectively couples to the wear bushing sleeve, and a lockdown ring that selectively couples to an inner surface of the wellhead housing and into interfering contact with an upper end of the wear bushing sleeve when the wear bushing body is landed in the wear bushing sleeve, so that when the wear bushing body is landed in the wear bushing sleeve and the wear bushing sleeve lands in the hanger, an axial lockdown force is transmitted between the hanger and the wellhead housing and through the wear bushing sleeve that opposes axial movement of the hanger in a direction towards the lockdown ring. Optionally included is a lock ring for coupling together the wear bushing body and wear bushing sleeve and that moves into interfering contact when an inner recess on the outer surface of the wear bushing body registers with an outer recess on the inner surface of the wear bushing sleeve. In this example, the wear bushing assembly is in a landed configuration when the inner and outer recesses are registered. Further in this example, the outer recess comprises a lower outer recess, and wherein the lock ring is in interfering contact with the inner recess and an upper outer recess on the outer surface of the wear bushing sleeve that is axially above the lower outer recess and when the wear bushing assembly is in a running configuration. Pins are included with this example that are radially extending through the wear bushing sleeve with inner ends that intersect the upper outer recess and outer ends that project radially outward past an outer surface of the wear bushing sleeve. The outer ends of the pins can contact the upper end of the hanger as the wear bushing sleeve is inserted into the hanger. The lockdown ring may be frangibly connected to the wear hushing body. In an alternative, the wear bushing body has an outer diameter that transitions radially outward for urging the lockdown ring into engagement with a groove formed on an inner surface of the wellhead housing. A profile of the inner surface of the wear bushing sleeve can define an upward facing shoulder on which a downward facing shoulder on an outer surface of the wear bushing body is supported when the wear bushing body is landed in the wear bushing sleeve.

In another example, a wear bushing assembly is disclosed that is for use with a wellhead assembly that has a wellhead housing. In this example the wear bushing is made up of an annular wear bushing sleeve having an inner bore that transitions radially inward a distance to define an upward facing shoulder, and having a lower portion that is selectively in interfering contact with a casing hanger that is landed in the wellhead housing. An annular wear bushing body is included that has an outer surface profiled to define a downward facing shoulder, and that is insertable in the wear bushing sleeve to a running position with the upward and downward facing shoulders spaced apart, and that is inserted in the wear bushing sleeve is to a landed position with the downward facing shoulder in interfering contact with the upward facing shoulder. This example further includes a lockdown ring circumscribing the wear bushing body and that selectively engages an inner surface of the wellhead housing and that is in interfering contact with an upper end of the wear bushing sleeve when the wear bushing body is in the landed position. A lock ring is optionally included that is for coupling together the wear bushing sleeve and the wear bushing body, and that is in interfering contact in an inner recess on an outer surface of the wear bushing body and an upper outer recess on an inner surface of the wear bushing sleeve when the wear bushing body is in the running position. The lock ring of this example is in interfering contact in the inner recess and a lower outer recess on an inner surface of the wear bushing sleeve when the wear bushing body is in the landed position, and wherein the lower outer recess is on a side of the upper outer recess opposite from the lockdown ring. This example embodiment further includes pins that project through a sidewall of the wear bushing sleeve and that are for urging the lock ring out of the upper recess so that the wear bushing body and lock ring slide axially with respect to the wear bushing sleeve until the inner recess and lower outer recess register with one another.

Another example of a wear bushing assembly is disclosed that is for use with a wellhead assembly having a wellhead housing. In this example the wear bushing assembly includes an annular wear bushing sleeve selectively inserted into the wellhead housing and landed on an upper end of a casing hanger, an annular wear bushing body selectively inserted into the wear bushing sleeve and moveable between a running position and a landed position that is axially spaced away from the running position, and a lockdown ring that circumscribes the wear bushing body and has undulations on an outer surface, and when the wear bushing body is in the landed position, the undulations engage a profiled portion on an inner surface of the wellhead housing so that the lock ring is in interfering contact with an upper end of the wear bushing sleeve. Also included is a protrusion on an outer surface of the wear bushing body for urging the lock ring radially outward into engagement with the profiled portion A lock ring for coupling the wear bushing body to the wear bushing sleeve can be included. An inner recess can be included that is on an outer surface of the wear bushing body, along with an upper outer recess on an inner surface of the wear bushing sleeve and that registers with the inner recess when the wear bushing body is in the running position, and a lower outer recess spaced axially away from the upper outer recess and on the inner surface of the wear bushing sleeve, and wherein the lower outer recess registers with the inner recess when the wear bushing body is in the landed position. In one example, when the wear bushing body is in the running position, the lock ring extends radially into the inner recess and upper outer recess and is in interfering contact with the wear bushing sleeve and wear bushing body thereby coupling together the wear bushing sleeve and wear bushing body, and wherein when the wear bushing body is in the landed position, the lock ring extends radially into the inner recess and lower outer recess and is in interfering contact with the wear bushing sleeve and wear bushing body thereby coupling together the wear bushing sleeve and wear bushing body. Optionally included are pins for frangibly coupling together the lockdown ring and the wear bushing body, and wherein when the wear bushing body is in the running position, an upper end of the wear bushing sleeve is in interfering contact with the lockdown ring, so that when the wear bushing body moves from the running position to the landed position, the wear bushing sleeve opposes axial movement of the lockdown ring thereby shearing the pins.

BRIEF DESCRIPTION OF DRAWINGS

Some of the features and benefits of the present invention having been stated, others will become apparent as the description proceeds when taken in conjunction with the accompanying drawings, in which.

Figure 1:
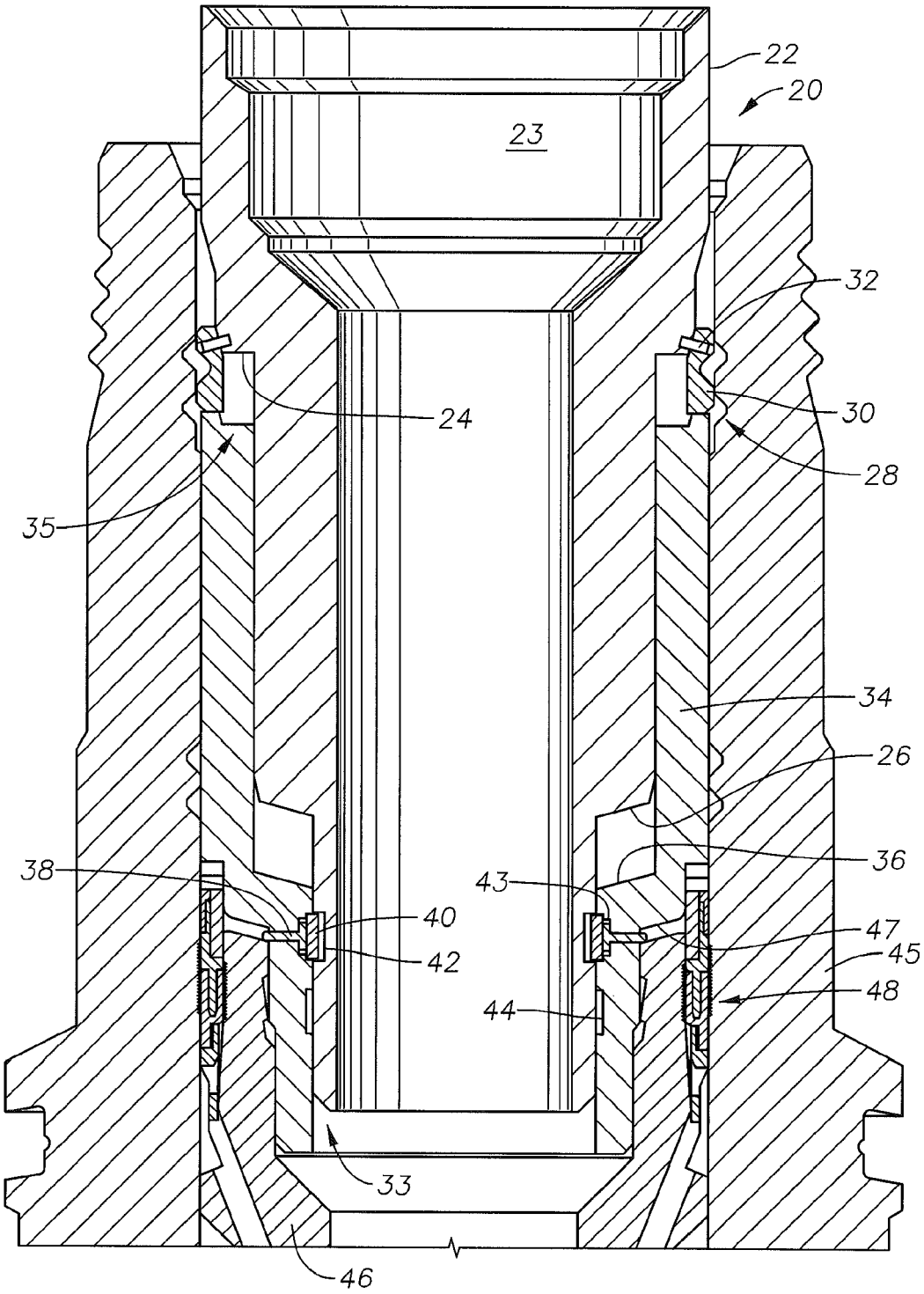
FIGS. 1-3 are side sectional views of an example of a wear bushing assembly being inserted into and locked down in a wellhead housing and in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term about includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 is a side sectional view of an example of a wear bushing assembly 20 that includes an annular wear bushing body 22 with a bore 23 shown formed axially through the body 22. The outer diameter of body 22 transitions radially inward to define a pair of downwardly facing shoulders 24, 26 that are spaced axially apart. A lockdown ring 28 is shown circumscribing an outer surface of the wear bushing body 22 and adjacent lower facing shoulder 24. In the example of FIG. 1 the outer curved surface of the lockdown ring 28 includes a pair of undulations that define a profile 30. The lockdown ring 28 couples with the wear bushing body 22 via pins 32 that project radially through the lockdown ring 28 and into an outer surface of the wear bushing body 28 just above downward facing shoulder 24. In the example of FIG. 1, the lower end of lockdown ring 28 depends between downward facing shoulder 24 and downward facing shoulder 26.

The wear bushing body 22 of FIG. 1 is shown inserted into a bore 33 that extends axially through an annular wear bushing sleeve 34. In the example of FIG. 1, the wear bushing body 22 is in what is referred to as a running position and wherein the lockdown ring 28 is in an interfering contact within an upper end 35 of the wear bushing sleeve 34. Illustrated axially spaced away from downward facing shoulder 26 is an upward facing shoulder 36 formed on an inner surface of wear bushing sleeve 34 where a radius of bore 33 transitions radially inward.

Push rods 38 are shown projecting radially through a side wall of wear bushing sleeve 34 and on a side of upward facing shoulder 36 opposite downward facing shoulder 26. The push rods 38 have elongate cylindrical bodies that project radially through the passages in the side wall of wear bushing sleeve 34. A piston like head is formed on an inner radial end of the push rods 38, and is shown in contact with an outer surface of a lock ring 40. Lock ring 40 circumscribes a lower portion of the wear bushing body 22, and has a cross section with an the axial height that is greater than its radial width. Lock ring 40 circumscribes an outer surface of wear bushing body 22, and its cross sectional radial width extends from within a portion of an inner recess 42 and radially outward into an upper outer recess 43 that is formed on an inner surface of wear bushing sleeve 34. Thus, when the wear bushing body 22 is in the running position and inserted within wear bushing sleeve 34, inner recess 42 is in registration with upper outer recess 43, and portions of the lock ring 40 are in recesses 42, 43 thereby coupling together the wear bushing body 22 and wear bushing sleeve 34. Spaced axially away from upper outer recess is a lower outer recess 44 formed along the inner surface of wear bushing sleeve 34.

In the example of FIG. 1, the wear bushing assembly 20 is being landed within a wellhead housing 45 that is part of a wellhead assembly. Also included with the wellhead assembly is a casing hanger 46, which is an annular member shown landed within wellhead housing 45 and below wear bushing assembly 20. A ledge 47 is shown that is axially spaced below where the upward facing shoulder 36 is formed on the inner surface of the wear bushing sleeve 34; ledge 47 faces downward and towards an upper end of casing hanger 46. Further in the example of FIG. 1 is shown an example of a seal assembly 48 between the outer surface of casing hanger 46 and inner surface of wellhead housing 45.

Figure 2:
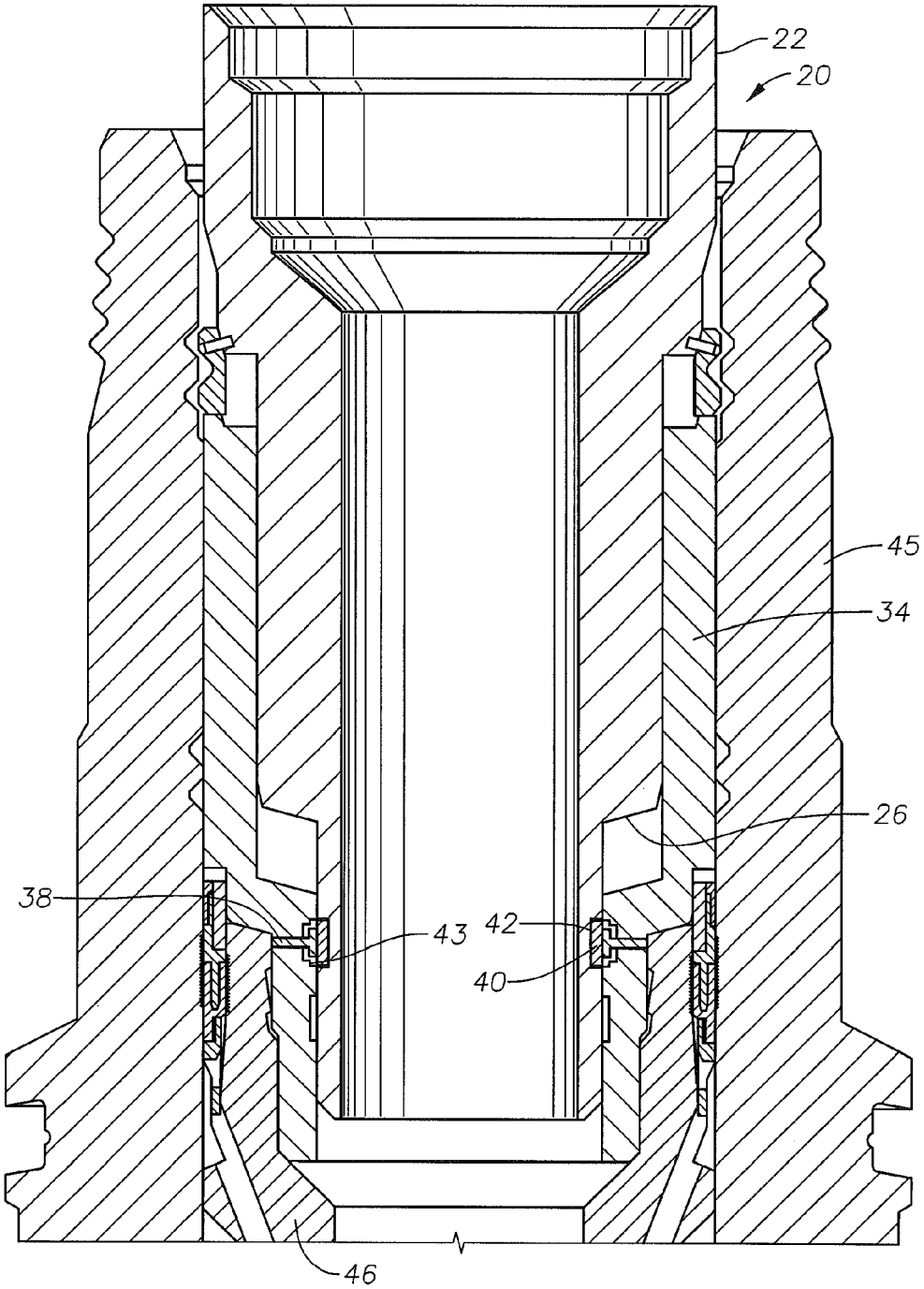

Referring now to FIG. 2, shown in side sectional view is an example of wear bushing assembly 20 moved axially downward from its position of FIG. 1, and landed on an upper end of casing hanger 46. In the position of FIG. 2, ledge 47 is in interfering contact with an upper end of casing hanger 46. As the outer radial tips of the push rods 38 extend past the outer circumference of the side wall of wear bushing sleeve 34, the tips of the push rods 38 come into interfering contact with an inner surface of casing hanger 46. The contact between casing hanger and push rods 38 urges push rods 38 radially inward so that the piston portion of the push rods 38 in turn urges the lock ring 40 radially inward and out of the upper outer recess 43. With lock ring 40 out of upper outer recess 43, the coupling between the wear bushing body 22 and wear bushing sleeve 34 is removed. Potential energy is stored in the lock ring 40 when it is radially compressed within the recess 42, wherein the potential energy exerts a force to expand lock ring 40 radially outward from recess 42. As will be described in further detail below, moving lock ring 40 into inner recess 42 allows where bushing body 22 to be moved from the running position to a landed position and axially downward within wear bushing sleeve 34.

Figure 3:
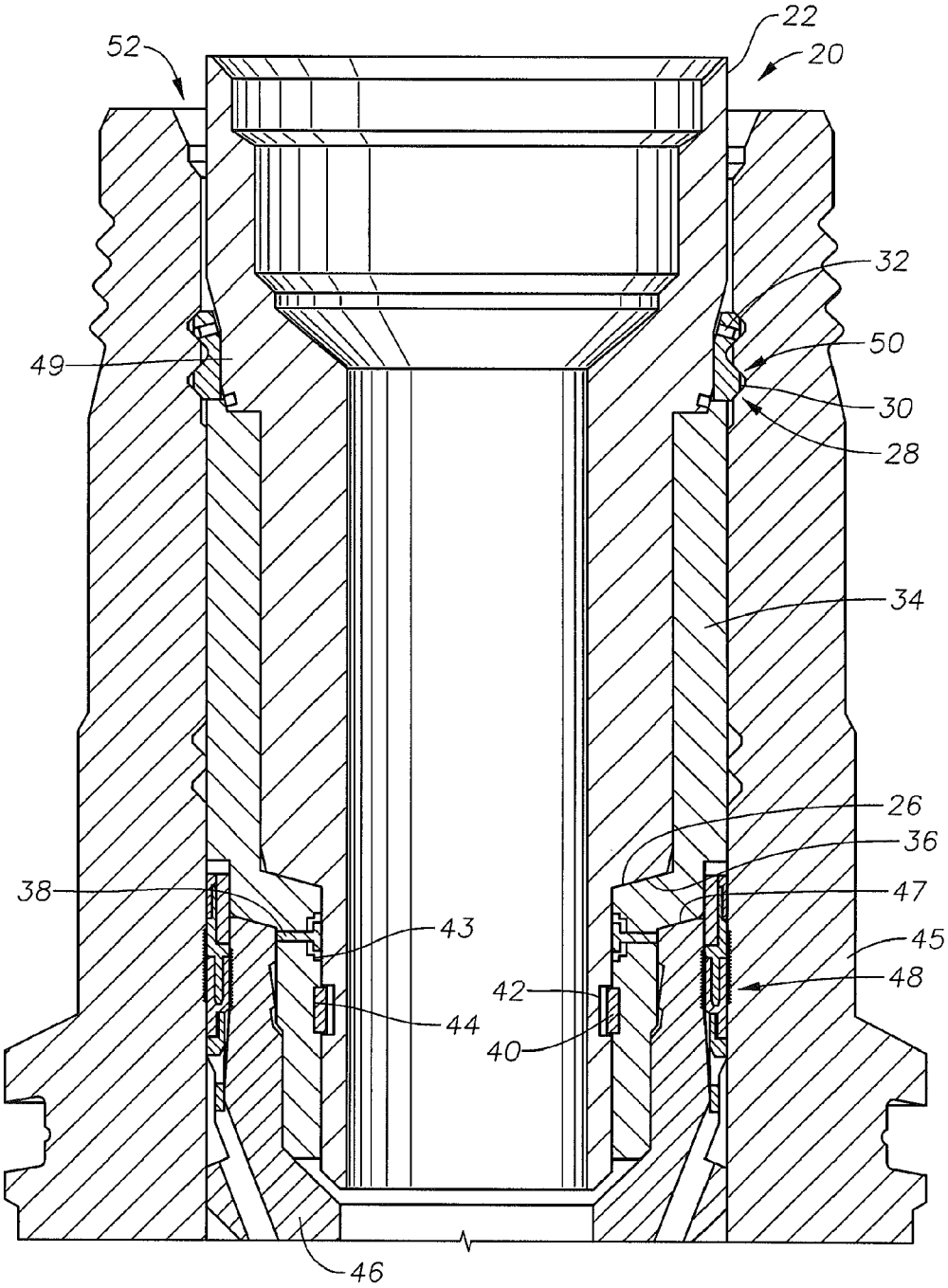

Referring now to FIG. 3, the wear bushing body 22 is moved axially downward into the landed position so that its downward facing shoulder 26 is in an interfering contact with the upward facing shoulder 36 of the wear bushing sleeve 34. In this configuration, inner recess 42 is moved into registration with lower outer recess 44, so that the potential energy stored within lock ring 40 causes it to radially expand and reside partially within each recess 42, 44. When portions of lock ring 40 are in recesses 42, 44, lock ring 40 couples together wear bushing body 22 wear bushing sleeve 34. Also, push pins 38 having been moved radially inward are positioned such that the outer radial portion is within the outer circumference of wear bushing sleeve 34 and the piston portion of the push rods is set within the upper outer recess 43. Because the lockdown ring 28 is in interfering contact with the upper end 35 of wear bushing sleeve 34 when in the running position, moving the wear bushing body 22 axially downward and into the landed position axially moves the lockdown ring 28 with respect to wear bushing body 22. This movement shears shear pins 32 thereby releasing the lockdown ring 28 from the wear bushing body 22.

The relative axial movement of wear bushing body 22 with respect to lockdown ring 28 positions lockdown ring 28 adjacent a protrusion 49 defined where the outer radius of wear bushing body 22 is increased. Protrusion 49 urges the lockdown ring 28 radially outward and into engaging contact with a groove 50 formed on an inner diameter surface of bore 52 created axially through wellhead housing 45. As such, not only is the wear bushing assembly 20 secured within wellhead housing 45, but because the ledge 47 on the lower end of wear bushing sleeve 34 is in interfering contact with the upper surface of casing hanger 46, the interfering contact between the upper end of wear bushing sleeve 34 and lockdown ring 28 puts the casing hanger 46 in a lockdown position within wellhead assembly. In an example, interfering contact between two bodies occurs by affixing one of the bodies in a space that interferes with movement of the other body through that space. The lockdown configuration of casing hanger 46 is achieved by its interfering contact with the ledge 40 of the wear bushing sleeve 34. Accordingly, axial forces created by thermal expansion of a casing string (not shown) coupled with the lower end of casing hanger 46 is countered by opposing forces generated by the interfering contact between the casing hanger 46 and wear bushing sleeve 34, and between wear bushing sleeve 34 and lockdown ring 28. Thus axial movement of the casing hanger 46 within wellhead housing 45 is opposed by the anchoring of the wear bushing assembly 20 by virtue of the lockdown ring 28 within profile 50.

Figure 4:
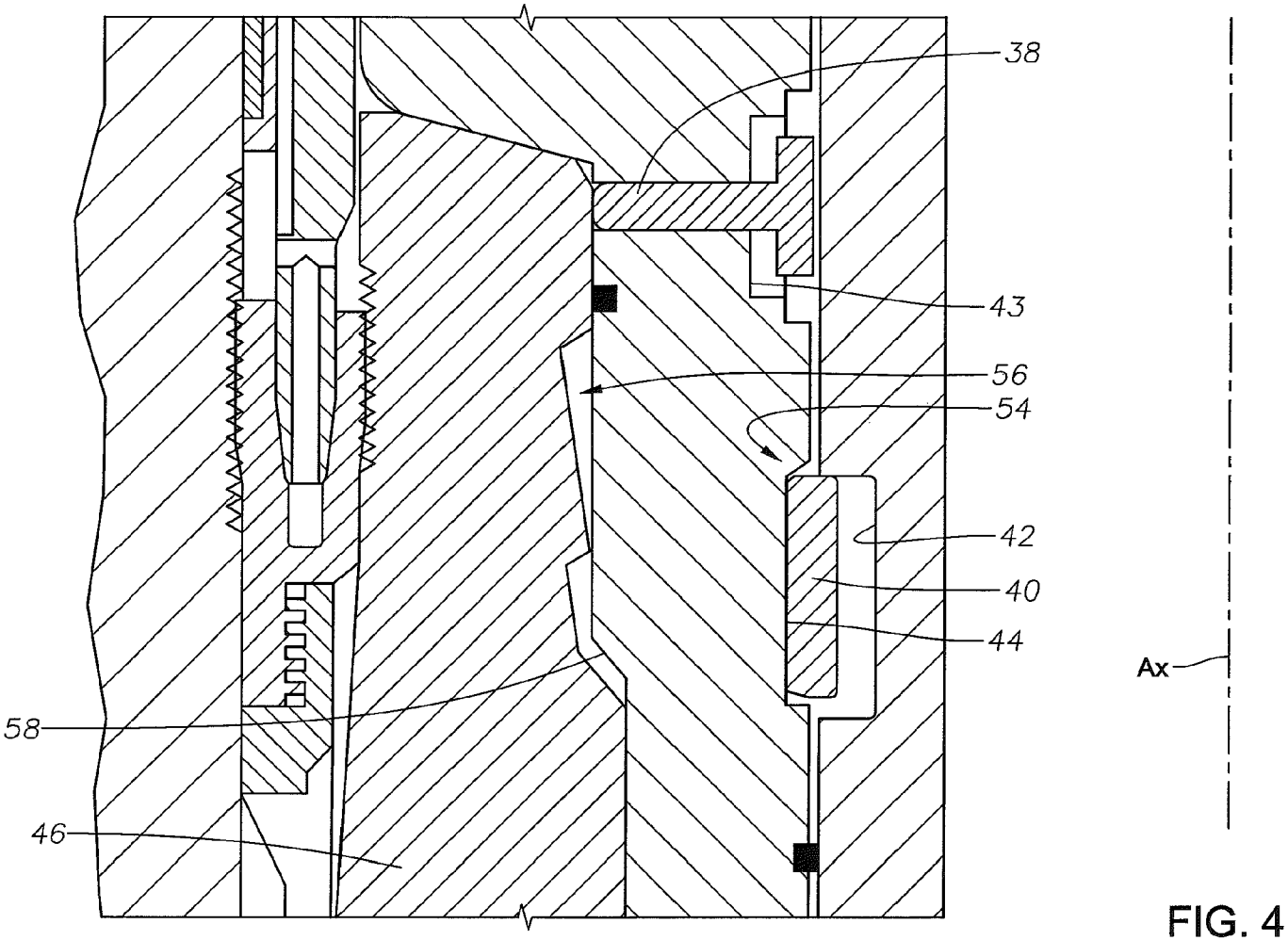
FIG. 4 is a side sectional detailed view of an example of a portion of the wear bushing assembly and wellhead housing of FIG. 3 and in accordance with the present invention.

FIG. 4 is a side sectional view of a portion of the wear bushing assembly 20 of FIG. 3 and inserted within casing hanger 46. As illustrated, the lock ring 40 occupies a portion of both the inner recess 42 and lower outer recess 44. To facilitate removal of the wear bushing assembly 20 when all operations are complete, an optional bevel is provided on an upper surface 54 of lower outer recess 44. In an example, the bevel reduces resistive forces of urging the lock ring 40 radially inward from the lower outer recess 44 and fully into inner recess 42 when upward forces applied to the wear bushing assembly 20 for its removal from within the wellhead housing 45. Further illustrated in FIG. 4 is a tie back profile 56 on an inner surface of casing hanger 46 and axially adjacent lower outer recess 44. As is known, tie back profile 56 provides a location for a running tool (not shown) to engage casing hanger 46 so casing hanger 46 may be landed within wellhead housing 45 (FIG. 3). A profile 58 on an outer surface of wear bushing sleeve 34 may be included that projects into a portion of the space defined by tie back profile 56.

In one example of operation, casing hanger 46 is landed within wellhead housing 45 by the running tool, and then the running tool is removed and then attached to the wear bushing assembly 20. Wear bushing assembly 20 is lowered into the wellhead housing 45 so it can be landed onto casing hanger 46 as illustrated in FIG. 2. Downward force provided via running tool onto wear bushing assembly 20 can generate the applied force for shearing shear pins 32 so that the wear bushing body 22 can be moved into the landed position of FIG. 3 from the running position of FIG. 1, and also urge the lockdown ring 28 into engaging contact with the profile 50 of wellhead housing 45. While wellbore operations, such as drilling or other actions that require insertion of tools within the wellhead housing 45 take place, the wear bushing assembly 20 remains in place to protect wellhead housing 45, and also exerts a lockdown force onto a casing hanger 46. As such, the need for a separate lock down system (not shown) is eliminated with the embodiments disclosed herein. At a designated time, such as when the aforementioned downhole operations have been completed, the running tool can engage the wear bushing assembly 20 and remove it from within wellhead housing 45 with an applied upward force to decouple lockdown ring 28 from within profile 50.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A wear bushing assembly for use with a wellhead assembly having a wellhead housing, the wear bushing assembly comprising:

an annular wear bushing sleeve having an inner surface defining a sleeve recess and a lower end selectively in interfering contact with an upper end of a hanger that is landed in the wellhead housing;

an annular wear bushing body having an outer surface defining a body recess and that inserts within and selectively couples to the wear bushing sleeve;

a lockdown ring that selectively couples to an inner surface of the wellhead housing and into interfering contact with an upper end of the wear bushing sleeve when the wear bushing body is landed in the wear bushing sleeve, so that when the wear bushing body is landed in the wear bushing sleeve and the wear bushing sleeve lands in the hanger, an axial lockdown force is transmitted between the hanger and the wellhead housing and through the wear bushing sleeve that opposes axial movement of the hanger in a direction towards the lockdown ring;

a lock ring that couples together the wear bushing sleeve and wear bushing body by moving into interfering contact when the sleeve recess registers with the body recess; and a push rod extending through the wear bushing sleeve and having a first end and a second end, the first end of the push rod contacting the lock ring, and the second end of the push rod projecting radially outward from the wear bushing sleeve so that as the lower end of the wear bushing sleeve moves toward the upper end of the hanger, the upper end of the hanger pushes the second end of the push rod toward the lock ring and the first end of the push rod in turn pushes the lock ring into the body recess so the wear bushing body can move axially relative to the wear bushing sleeve.

2. The wear bushing assembly of claim 1, wherein the wear bushing assembly is in a landed configuration when the body and sleeve recesses are registered.

3. The wear bushing assembly of claim 1, wherein the sleeve recess comprises a lower sleeve recess, and wherein the lock ring is in interfering contact with the body recess and an upper sleeve recess on the outer surface of the wear bushing sleeve that is axially above the lower sleeve recess and when the wear bushing assembly is in a running configuration.

4. The wear bushing assembly of claim 3, wherein the push rod radially extends through the wear bushing sleeve with the first end of the push rod that intersecting the upper sleeve recess.

5. The wear bushing assembly of claim 4, wherein the second end of the push rod contacts the upper end of the hanger as the wear bushing sleeve is inserted into the hanger.

6. The wear bushing assembly of claim 1, wherein the lockdown ring is frangibly connected to the wear bushing body.

7. The wear bushing assembly of claim 1, wherein the wear bushing body has an outer diameter that transitions radially outward for urging the lockdown ring into engagement with a groove formed on an inner surface of the wellhead housing.

8. The wear bushing assembly of claim 1, wherein a profile of the inner surface of the wear bushing sleeve defines an upward facing shoulder on which a downward facing shoulder on an outer surface of the wear bushing body is supported when the wear bushing body is landed in the wear bushing sleeve.

9. A wear bushing assembly for use with a wellhead assembly having a wellhead housing, the wear bushing assembly comprising: an annular wear bushing sleeve having an inner surface defining a sleeve recess and an inner bore that transitions radially inward a distance to define an upward facing shoulder, and having a lower portion that is selectively in interfering contact with a casing hanger that is landed in the wellhead housing; an annular wear bushing body having an outer surface defining a body recess and an outer surface profiled to define a downward facing shoulder, and that is insertable in the wear bushing sleeve to a running position with the upward and downward facing shoulders spaced apart, and that is inserted in the wear bushing sleeve is to a landed position with the downward facing shoulder in interfering contact with the upward facing shoulder; a lockdown ring circumscribing the wear bushing body and that selectively engages an inner surface of the wellhead housing and that is in interfering contact with an upper end of the wear bushing sleeve when the wear bushing body is in the landed position; a lock ring that couples to the wear bushing sleeve and wear bushing body by moving into interfering contact when the sleeve recess registers with the body recess; and a push rod extending through the wear bushing sleeve and having a first end and a second end, the first end of the push rod contacting the lock ring, and the second end of the push rod projecting radially outward from the wear bushing sleeve so that as the lower portion of the wear bushing sleeve moves toward the hanger, the hanger pushes the second end of the push rod toward the lock ring and the first end of the push rod in turn pushes the lock ring into the body recess so the wear bushing body can move axially relative to the wear bushing sleeve.

10. The wear bushing assembly of claim 9, wherein the sleeve recess includes an upper sleeve recess and a lower sleeve recess, and wherein the lock ring is in interfering contact between the body recess and the upper sleeve recess when the sear bushing body is in the running position, and in interfering contact between the body recess and the lower sleeve recess when the wear bushing body is in the landed position.

11. The wear bushing assembly of claim 10, wherein the push rod projects through a sidewall of the wear bushing sleeve for urging the lock ring out of the upper sleeve recess so that the wear bushing body and lock ring slide axially with respect to the wear bushing sleeve until the body recess and lower sleeve recess register with one another.

12. A wear bushing assembly for use with a wellhead assembly having a wellhead housing, the wear bushing assembly comprising: an annular wear bushing sleeve selectively inserted into the wellhead housing and landed on an upper end of a casing hanger; an annular wear bushing body selectively inserted into the wear bushing sleeve and moveable between a running position and a landed position that is axially spaced away from the running position; a lockdown ring that circumscribes the wear bushing body and has undulations on an outer surface, and when the wear bushing body is in the landed position, the undulations engage a profiled portion on an inner surface of the wellhead housing so that the lock ring is in interfering contact with an upper end of the wear bushing sleeve; and a protrusion on an outer surface of the wear bushing body for urging the lock ring radially outward into engagement with the profiled portion; and a body recess on an outer surface of the wear bushing body, an upper sleeve recess on an inner surface of the wear bushing sleeve that registers with the body recess when the wear bushing body is in the running position, and a lower sleeve recess spaced axially away from the upper sleeve recess and on the inner surface of the wear bushing sleeve that registers with the body recess when the wear bushing body is in the landed position.

13. The wear bushing assembly of claim 12, further comprising a lock ring for coupling the wear bushing body to the wear bushing sleeve.

14. The wear bushing assembly of claim 13, wherein when the wear bushing body is in the running position, the lock ring extends radially into the body recess and upper sleeve recess and is in interfering contact with the wear bushing sleeve and wear bushing body thereby coupling together the wear bushing sleeve and wear bushing body, and wherein when the wear bushing body is in the landed position, the lock ring extends radially into the body recess and lower sleeve recess and is in interfering contact with the wear bushing sleeve and wear bushing body thereby coupling together the wear bushing sleeve and wear bushing body.

15. The wear bushing assembly of claim 12, further comprising pins for frangibly coupling together the lockdown ring and the wear bushing body, and wherein when the wear bushing body is in the running position, an upper end of the wear bushing sleeve is in interfering contact with the lockdown ring, so that when the wear bushing body moves from the running position to the landed position, the wear bushing sleeve opposes axial movement of the lockdown ring thereby shearing the pins.

* * * * *